US007744135B2

(12) United States Patent
Wiese et al.

(10) Patent No.: US 7,744,135 B2
(45) Date of Patent: Jun. 29, 2010

(54) ADJUSTABLE STRIKER BOLT SYSTEM AND METHOD

(75) Inventors: David A. Wiese, Peoria, IL (US); Michael E. Lee, Chilicothe, IL (US); Derick L. Hinderliter, Mapleton, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 12/098,695

(22) Filed: Apr. 7, 2008

(65) Prior Publication Data

US 2009/0250947 A1 Oct. 8, 2009

(51) Int. Cl.
*E05B 15/02* (2006.01)
*E05B 15/00* (2006.01)

(52) U.S. Cl. ..... 292/341.15; 292/340; 292/341.18; 292/341.19

(58) Field of Classification Search ..... 292/340, 292/341, 341.15, 341.18, 341.19
See application file for complete search history.

(56) References Cited

U.S. PATENT DOCUMENTS 513,667 A * 1/1894 Buckingham ..... 292/341.18
2,265,691 A * 12/1941 Hogg ..... 292/341.18
2,401,854 A * 6/1946 Berry, Jr. ..... 292/341.19
2,669,477 A * 2/1954 Jewell ..... 292/341.18
2,710,217 A * 6/1955 Curtiss, Jr. et al. ..... 292/341.18
2,956,829 A * 10/1960 Gerth ..... 292/341.15
3,179,458 A * 4/1965 Sconzo ..... 292/341.15
4,087,123 A * 5/1978 Redshaw ..... 292/341.19
4,691,952 A * 9/1987 Harmon ..... 292/341.18
4,798,408 A * 1/1989 Harmon et al. ..... 292/341.18
4,852,923 A * 8/1989 Harmon et al. ..... 292/341.18
4,906,037 A * 3/1990 Stammreich et al. ... 292/341.18
6,155,618 A * 12/2000 Ichinose ..... 292/340
6,260,304 B1 * 7/2001 Groeneveld ..... 49/395
6,783,163 B2 * 8/2004 Sadler ..... 292/341.18
2005/0052033 A1 * 3/2005 Pfitzinger et al. ..... 292/216
2009/0108591 A1 * 4/2009 De Vries ..... 292/64

* cited by examiner

*Primary Examiner*—Carlos Lugo
(74) *Attorney, Agent, or Firm*—Richard K. C. Chang, II

(57) ABSTRACT

An adjustable striker bolt assembly includes a mount having a first slot oriented along a first axis and a second slot oriented along a second axis. The second axis is disposed at a predetermined angle to the first axis. The adjustable striker bolt assembly further includes a striker bolt supported in the second slot of the mount.

14 Claims, 2 Drawing Sheets

ADJUSTABLE STRIKER BOLT SYSTEM AND METHOD

TECHNICAL FIELD

This invention relates generally to an adjustable striker bolt system and method for providing a consistent engagement with a latch.

BACKGROUND

Typically, striker bolts are mounted to a frame and engage the latch of a door. However, for the door to close properly, the striker bolt may be mounted after the door has been pivotally attached to the frame in order to ensure proper placement of the striker bolt relative to the latch of the door. This mounting arrangement may provide unsatisfactory latching over time as the hinges may bend with use. Additionally, if the door or the hinges are replaced, the striker bolt may not be properly positioned. Consequently, new mounting holes may need to be drilled, which may be unaesthetic and potentially act as contamination points for dirt, water, debris, and other contaminants to get into the frame. Further, this contamination may build up and compromise the structural integrity of the frame.

When used in machines, the striker bolt has become important in sealing a door to a frame of an operator or passenger compartment. Specifically, as requirements for sealing the operator or passenger compartment have increased in order to minimize noise and protect occupants from dust, the problems in mounting and positioning the striker bolt have been compounded.

SUMMARY OF THE INVENTION

In one example of the present invention, an adjustable striker bolt assembly may include a mount having a first slot oriented along a first axis and a second slot oriented along a second axis. The second axis is disposed at a predetermined angle to the first axis. A striker bolt may be supported in the second slot of the mount.

In one aspect, a kit for an adjustable striker bolt may include a mount having a first slot oriented along a first axis and a second slot oriented along a second axis with the second axis being disposed at a predetermined angle to the first axis. The kit may include a striker bolt including an attachment portion. The second slot of the mount may be shaped to receive the attachment portion. Additionally, the kit may include a coupler attachable to the attachment portion.

In another aspect, a method for positionally adjusting a striker bolt may include sliding a first slot of a mount relative to a fastener to positionally adjust the striker bolt along a first axis and securing the fastener to the first slot. The method may also include sliding the striker bolt within a second slot of the mount to positionally adjust the striker bolt along a second axis. The second axis is disposed at a predetermined angle to the first axis. Further, the method may include securing the striker bolt to the second slot of the mount.

In another aspect, a compartment may include a frame and a door pivotally attached to the frame. The compartment may further include a adjustable striker bolt assembly and a latch respectively mounted on one of the frame and door. The adjustable striker bolt assembly may include a mount having a first slot oriented along a first axis and a second slot oriented along a second axis with the second axis being disposed at a predetermined angle to the first axis. The adjustable striker bolt assembly may also include a striker bolt supported in the second slot of the mount. Additionally, the operator compartment may include a seal interposing the door and the frame when the latch engages the striker bolt.

DETAILED DESCRIPTION

Figure 1:
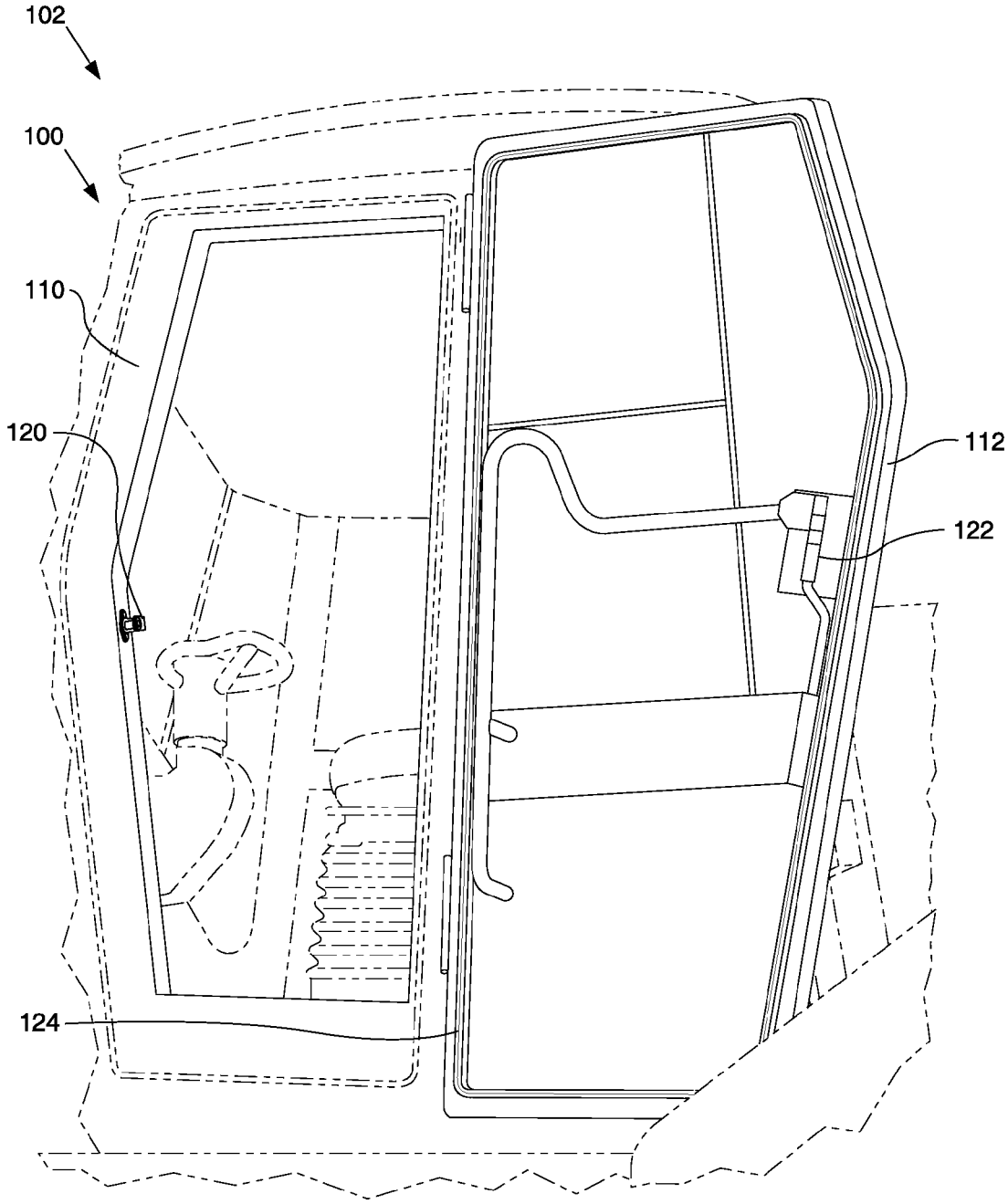
FIG. 1 is a broken view of a compartment of a machine.

Referring to FIG. 1, a broken view illustrates a compartment 100 of a machine 102. More specifically, the compartment 100 is an operator compartment, but may be another compartment known in the art, such as an engine, transmission, or storage compartment. As shown, the compartment 100 includes a frame 110 and a door 112 pivotally attached to the frame 110.

The compartment 100 also includes an adjustable striker bolt assembly 120 mounted on the frame 110 and a latch 122 mounted on the door 112. The latch 122 is configured to engage the adjustable striker bolt assembly 120 and retain the door 112 in a closed position against the frame 110. Alternatively, though not shown, the latch 122 may be mounted on the frame 110 and the adjustable striker bolt assembly 120 mounted on the door 112.

As shown, a seal 124 is attached to the door 112. Alternatively, the seal 124 may be attached to the frame 110. Consequently, the seal 124 interposes the door 112 and the frame 110 when the latch 122 engages the adjustable striker bolt assembly 120. The seal 124 may permit the compartment 100 to be pressurized and sealed against the environment external to the compartment 100, which may reduce noise, dust, and other contaminants within the compartment 100 from external sources.

Figure 2:
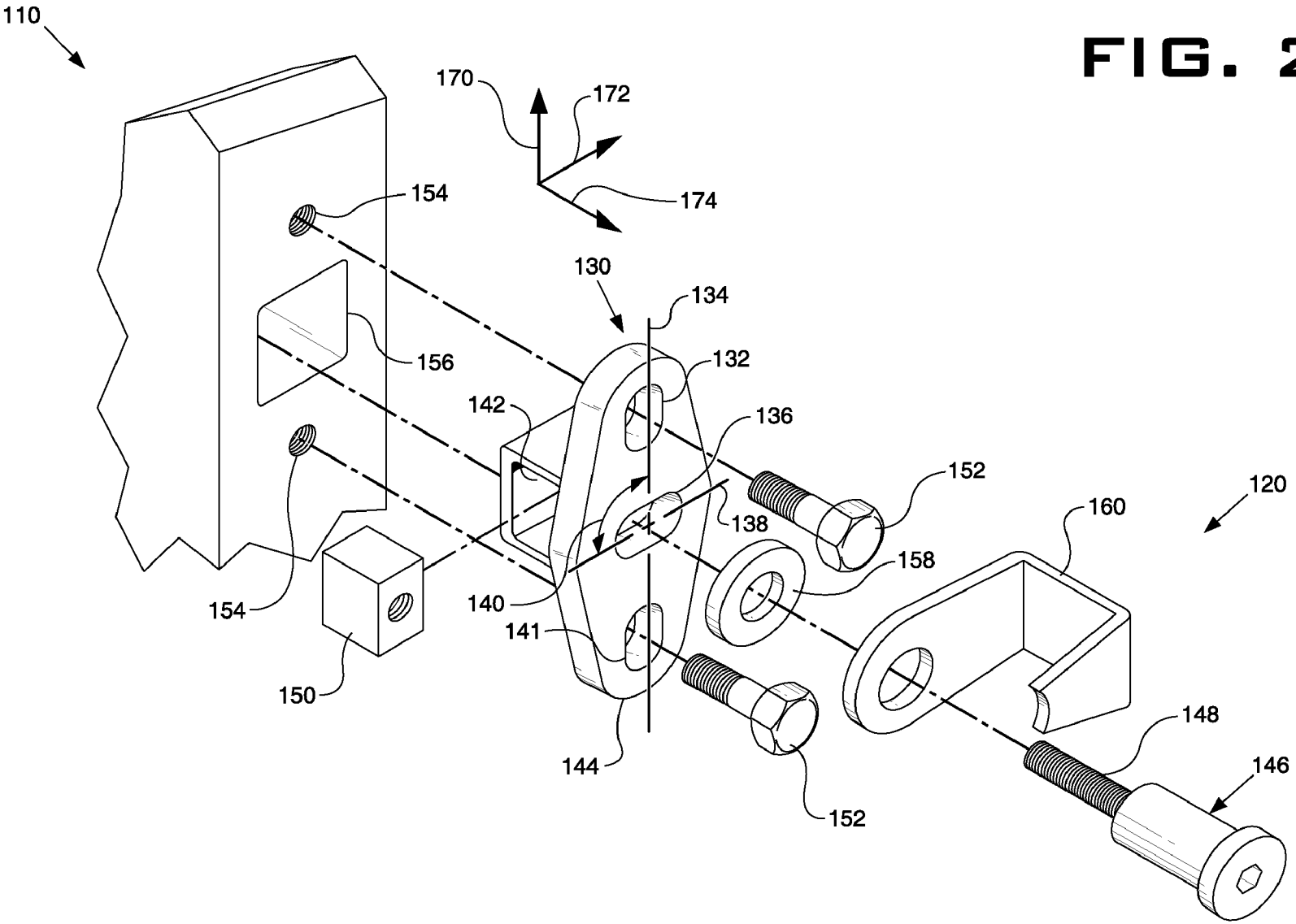
FIG. 2 is an exploded view of the adjustable striker bolt mounted to the frame of the operator compartment.

Referring to FIG. 2, an exploded view illustrates the adjustable striker bolt assembly 120 and frame 110 of the compartment 100. As shown, the adjustable striker bolt assembly 120 includes a mount 130. The mount 130 may include a first slot 132 oriented along a first axis 134 and a second slot 136 oriented along a second axis 138.

The second axis 138 may be disposed at a predetermined angle 140 to the first axis 134. For example, the angle 140 between the first and second axis 134, 138 may range between about thirty and about one hundred fifty degrees. Alternatively, the angle 140 may range between about forty-five and about one hundred thirty-five degrees. In yet another alternative, the angle 140 may range between about seventy-five and about one hundred five degrees. In yet others and as illustrated, the first axis 134 may be disposed generally perpendicular to the second axis 138.

The mount 130 may also include a third slot 141 oriented parallel to the first slot 132. In the illustrated configuration, the second slot 136 may interpose the first and third slots 132, 141.

The mount 130 may further include a feature 142 aligned with the second slot 136. As shown, the feature 142 may be a rail or channel having a rectangular cross-sectional area. For example, the feature 142 may be formed of bent sheet metal welded to a plate 144 of the mount 130. Alternatively, the feature 142 may have any cross-sectional area, such as circular, triangular, hexagonal, T-shaped, X-shaped, or L-shaped.

The adjustable striker bolt assembly 120 includes a striker bolt 146 supported in the second slot 136 of the mount 130. The striker bolt 146 includes an attachment portion 148. As shown, the attachment portion 148 may be threaded to facilitate attachment to the mount 130. It should be recognized that other configurations of the attachment portion 148 may be provided such as barbs, quick connect features, and being shaped for pressed or swaged attachment. Additionally, the attachment portion 148 may be configured to extend through the second slot 136 with the second slot 136 being shaped to receive the attachment portion.

The adjustable striker bolt assembly 120 may further include a coupler 150 attached to the attachment portion 148 in order to secure the striker bolt 146 to the mount 130. As shown, the coupler 150 may be an internally threaded square nut. However, as may be recognized by one of skill in the art, the coupler 150 may include other features and take other configurations, such as a quick coupler configuration, a hexagonal nut, or other mating features known in the art.

The coupler 150 may be supported by the feature 142 and attached to the attachment portion 148 of the striker bolt 146 extending through the second slot 136. In the configuration shown, the coupler 150 and the feature 142 may be shaped to prevent rotation of the coupler 150 to facilitate loosening and tightening of the coupler 150 to the striker bolt 146. For example, the feature 142 may have a rectangular cross-sectional area and the coupler 150 may have a mating cross-sectional area. Consequently, in the configuration shown, the coupler 150 may be loosely attached to the striker bolt 146 so that the striker bolt 146 can slide in the second slot 136 and the coupler 150 can respectively slide within the feature 142.

The adjustable striker bolt assembly 120 may also include fasteners 152 that may engage and be fastened to the frame 110 at mount holes 154. When mounted to the frame 110, the feature 142 may be disposed within a recess 156 in the frame 110.

In addition to the components discussed above, the adjustable striker bolt assembly 120 may further include a washer 158 and a striker guard 160.

INDUSTRIAL APPLICABILITY

The adjustable striker bolt assembly 120 may provide consistent sealing the door 112 against the frame 110 of a machine 102. This may be achieved by being able to adjustably position the striker bolt 146 of the adjustable striker bolt assembly 120 to engage the latch 122. Adjustment is provided for through the first and second slots 132, 136. For example, when the first and second slots 132, 136 are oriented generally perpendicular to each other, the first slot 132 may provide for vertical position 170 adjustments and the second slot 136 may provide for horizontal position 172 adjustments of the striker bolt 146. Alternatively, the mount 130 may be oriented so that the first slot 132 provides for horizontal position 172 adjustments and the second slot 136 provides for vertical position 170 adjustments of the striker bolt 146. However, as may be recognized by one of skill in the art, the mount 130 and the first and second slots 132, 136 may be oriented relative to each other to provide wide variety of positional adjustments.

Additionally, the washer 158 may be sized or the adjustable striker bolt assembly 120 may include a plurality of washers 158 to provide orthogonal position 174 adjustments to the striker bolt 146. In other words, one or more washers 158 may provide for positional adjustment in a direction orthogonal to the first and second axis 134, 138.

More generally, a method for positionally adjusting a striker bolt 146 may include the steps of loosening the fasteners 152, sliding the mount 130 relative to a fastener 152 to positionally adjust the striker bolt 146 along a first axis 134, and securing the fastener 152 to the first slot 132. Securing the fastener 152 may be accomplished by tightening the fastener 152 in the mounting holes 154 against the mount 130. Further, the method may include sliding the striker bolt 146 within a second slot 136 of the mount 130 to positionally adjust the striker bolt 146 along a second axis 138. Sliding the striker bolt 146 within a second slot 136 of the mount 130 may include supporting the coupler 150 by the feature 142 and sliding the coupler 150 on the feature 142.

Additionally, the method may include securing the striker bolt 146 to the mount 130. More specifically, securing the striker bolt 146 to the mount 130 may include positioning the attachment portion 148 of the striker bolt 146 through the second slot 136 of the mount 130 and securing the coupler 150 to the attachment portion 148.

Further, the method may include adding additional washers, removing one or more washers, or replacing the washer 158 with one or more washers to adjust the orthogonal position of the striker bolt 146. This step may be accompanied by the further step of disengaging the attachment portion 148 from the coupler 150 and attaching the attachment portion 148 to the coupler 150.

As may be recognized by one of skill in the art, the adjustable striker bolt assembly 120 may be prepared, transported, and/or sold disassembled as an adjustable striker bolt kit.

What is claimed is:

1. An adjustable striker bolt assembly comprising:

a mount having a first slot oriented along a first longitudinal axis and a second slot oriented along a second longitudinal axis, the second longitudinal axis being disposed at a predetermined angle to the first longitudinal axis, wherein the first slot is shaped to permit a fastener to extend through the first slot;

a striker bolt supported by the mount, the striker bolt including an attachment portion, the attachment portion extending generally orthogonally to the first longitudinal axis and the second longitudinal axis through the second slot, wherein the first slot provides for the positional adjustment of the striker bolt along the first longitudinal axis and the second slot provides for the positional adjustment of the striker bolt along the second longitudinal axis; and a coupler attached to the attachment portion to secure the striker bolt to the mount, wherein the mount includes a feature aligned with the second slot, wherein the coupler is supported by the feature, wherein the feature extends along the second longitudinal axis and is shaped to prevent rotation of the coupler.

2. The adjustable striker bolt assembly of claim 1, wherein the first longitudinal axis is disposed generally perpendicular to the second axis.

3. The adjustable striker bolt assembly of claim 1, wherein the feature is a channel having a rectangular cross-sectional area and the coupler is a nut having a mating cross-sectional area.

4. The adjustable striker bolt assembly of claim 1, wherein the mount includes a third slot oriented parallel to the first slot, wherein the second slot interposes the first and third slots.

5. The adjustable striker bolt assembly of claim 1, wherein the first slot provides for vertical position adjustment of the striker bolt and the second slot provides for horizontal position adjustment of the striker bolt.

6. The adjustable striker bolt assembly of claim 1, further comprising one or more washers disposed about the attachment portion of the striker bolt to orthogonally position the striker bolt relative to the mount.

7. An adjustable striker bolt kit comprising:

a mount having a first slot oriented along a first longitudinal axis and a second slot oriented along a second longitudinal axis, the second longitudinal axis being disposed at a predetermined angle to the first longitudinal axis, wherein the mount includes a feature aligned with the second slot;

a striker bolt including an attachment portion, wherein the second slot is shaped to receive the attachment portion; and a coupler attachable to the attachment portion, wherein the first slot provides for vertical position adjustment of the striker bolt and the second slot provides for horizontal position adjustment of the striker bolt, wherein the coupler is supportable by the feature, the feature being shaped to prevent rotation of the coupler.

8. The adjustable striker bolt kit of claim 7, wherein the second longitudinal axis is disposed generally perpendicular to the first longitudinal axis.

9. A method for positionally adjusting a striker bolt, the method comprising:

sliding a mount relative to a fastener extending through a first slot of the mount to positionally adjust the striker bolt along a first longitudinal axis, wherein sliding the striker bolt within the second slot of the mount includes supporting the coupler by a feature of the mount aligned with the second slot, wherein the feature is shaped to prevent rotation of the coupler;

securing the fastener to the mount;

sliding the striker bolt within a second slot of the mount to positionally adjust the striker bolt along a second longitudinal axis, the second longitudinal axis being disposed at a predetermined angle to the first longitudinal axis; and securing the striker bolt to the mount, wherein the striker bolt extends generally orthogonally to the first longitudinal axis and the second longitudinal axis through the second slot.

10. The method of claim 9, wherein the first longitudinal axis is disposed generally perpendicular to the second longitudinal axis.

11. The method of claim 9, wherein sliding the mount relative to a fastener adjusts a vertical position of the striker bolt, wherein sliding the striker bolt within a second slot adjusts a horizontal position of the striker bolt.

12. The method of claim 9, wherein securing the striker bolt to the mount includes securing an attachment portion of the striker bolt to a coupler through the second slot of the mount.

13. A compartment comprising:

a frame;

a door pivotally attached to the frame;

an adjustable striker bolt assembly mounted on one of the frame and the door, the adjustable striker bolt assembly including a mount having a first slot oriented along a first longitudinal axis and a second slot oriented along a second longitudinal axis, the second longitudinal axis being disposed at a predetermined angle to the first longitudinal axis, and a striker bolt supported in the second slot of the mount, wherein the first slot provides for vertical position adjustment of the striker bolt and the second slot provides for horizontal position adjustment of the striker bolt, the adjustable striker bolt assembly including a coupler attached to the striker bolt to secure the striker bolt to the mount, wherein the mount includes a feature aligned with the second slot, wherein the coupler is supported by the feature, wherein the feature extends along the second longitudinal axis and is shaped to prevent rotation of the coupler;

a latch mounted on the other of the one of the frame and the door, the latch configured to engage the striker bolt; and a seal interposing the door and the frame when the latch engages the striker bolt.

14. The compartment of claim 13, wherein the first longitudinal axis is disposed generally perpendicular to the second longitudinal axis.

* * * * *